United States Patent [19]

Boone

[11] 4,235,333

[45] Nov. 25, 1980

[54] BATHROOM EQUIPMENT

[76] Inventor: Philip Boone, 15 Fenwick Rd., Winchester, Mass. 01890

[21] Appl. No.: 906,671

[22] Filed: May 30, 1978

Related U.S. Application Data

[63] Continuation-in-part of Ser. No. 798,465, May 19, 1977, Pat. No. 4,106,617.

[51] Int. Cl.[2] ..... B65H 19/02

[52] U.S. Cl. ..... 206/233; 206/494; 206/812; 242/55.53; 248/201; 220/18

[58] Field of Search ..... 206/233, 390, 555, 554, 206/494, 225, 812, 409; 242/55.3, 55.53, 55.55; 312/39; 221/45; 248/201, 222.4, 223.1, 223.2, 225.1, 225.2; 220/18

[56] References Cited

U.S. PATENT DOCUMENTS

| | | | |
|---|---|---|---|
| 1,307,139 | 6/1919 | Morden | 206/494 |
| 2,373,092 | 4/1945 | Avery | 206/390 X |
| 2,859,606 | 11/1958 | Scardino | 220/18 |
| 2,928,568 | 3/1960 | Franklin | 220/18 X |
| 2,930,505 | 3/1960 | Meyer | 220/18 |
| 3,089,583 | 5/1963 | White | 206/233 |
| 3,155,235 | 11/1964 | Maich | 206/494 |
| 3,524,584 | 8/1970 | Vevirit et al. | 220/18 X |
| 3,613,142 | 10/1971 | Chaney, Jr. | 206/390 X |
| 3,710,977 | 1/1973 | van den Enden et al. | 206/555 |
| 3,824,953 | 7/1974 | Boone | 206/225 X |

FOREIGN PATENT DOCUMENTS

| | | | |
|---|---|---|---|
| 1411684 | 10/1975 | United Kingdom | 200/494 |

*Primary Examiner*—Joseph Man-Fu Moy

[57] ABSTRACT

A bathroom fixture of improved construction, function and appearance for making available both conventional toilet-tissue and a supplemental material, for example a moistening material for application to the human body such as premoistened sheets manually withdrawable from a container or housing component.

20 Claims, 12 Drawing Figures

BATHROOM EQUIPMENT

The present invention is a continuation-in-part of my copending U.S. Pat. application Ser. No. 798,465, filed May 19, 1977 now U.S. Pat. No. 4,106,617.

BRIEF SUMMARY OF THE INVENTION

The subject invention relates to improved means in the form of an integral fixture adapted to provide a plurality of units for treating the human body as, for example, units embodying a moistening substance for supplementing a dry toilet-tissue to provide a new and improved standard of cleaniness. Structural and functional advantages of the fixture, to be described, are thought to warrant its adoption as a standard item of well-ordered and efficient bathroom equipment.

In view of the foregoing considerations objects of the invention are to provide an integral fixture comprising a toilet-tissue dispenser, a container for carrying the units for applying the body treatment, and support means for uniting the toilet-tissue dispenser and container to form a fixture which is complete in itself for accomplishing a more efficient cleansing function; to provide a plurality of units of the type mentioned so contained or housed as to be adapted to individual withdrawal for usage; to provide releasable and, alternatively, fixed mounting of the unit-containing means adjacent to the toilet-tissue dispensing component; to provide body-treatment materials suitable to employment by the fixture; to provide a fixture adapted to a recessed mounting of the unit container means for meeting limited space characteristics of the bathroom and effecting operational convenience; and to provide an attractive, structurally simple and moderately priced device of the character described. Other objects of the invention will in part be obvious and will in part appear hereinafter.

BRIEF DESCRIPTION OF THE DRAWING

The novel features which are believed to be characteristic of the invention are set forth with particularity in the appended claims. The invention, however, both as to its organization and its method of operation will best be understood from the following description when read in connection with the accompanying drawing wherein like numbers have been employed in the different figures to denote like parts and wherein:

DETAILED DESCRIPTION

Figure 1:
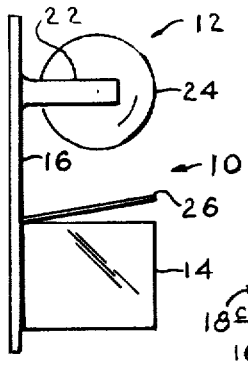
FIG. 1 is a diagrammatic side elevation view of one form of the fixture in which the toilet-tissue dispensing means and a support member mounting a container are attached to a wall panel or section component; the dispensing means and container are in vertical alignment.
Figure 2:
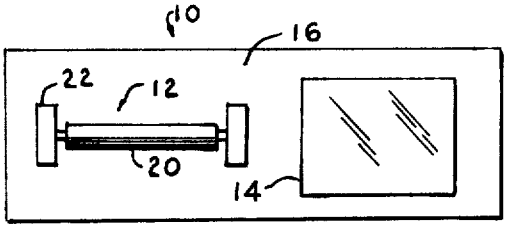
FIG. 2 is a front view of the unitary fixture in which the toilet-tissue dispensing means and the support member components are attached to a wall panel but are horizontally disposed.

In FIGS. 1 and 2 there is illustrated a unitary fixture 10 comprising, basically, a dry toilet-tissue dispensing means 12, a container 14 releasably holding a plurality of units for treating the human body such as moistening material for use supplemental to that of the toilet-tissue, and support means 16 for the dispensing means 12 and container 14 in the form of a rigid, high-tensile-strength panel or section which also constitutes a portion of a wall or other vertical surface adjacent to a toilet bowl. An additional support member or bracket 18 (FIG. 3) formed preferably of a metal may, optionally, be positioned between the section 16 and the container 14 for mutual attachment to at least the container and section. It may also mount the toilet-tissue dispenser if lengthened as shown in FIG. 3.

The toilet-tissue dispenser 12 and container 14 are disposed vertically in FIG. 1 and horizontally in FIG. 2. The dispenser 12 comprises a retractable spindle 20 mounted between a pair of posts 22, the spindle being adapted to carry a roll of toilet-tissue 24. The posts 22 are anchored to the support section 16 by any suitable means such as bolts, screws or an adhesive. A pivotal or otherwise releasably attached cover 26 provides a seal and permits access to the container interior for loading and removal of the units. The angled portion 18*a* of member 18 provides additional support of the container.

As indicated, both the container 14 and the dispenser 12 may be fastened directly to the section 16. Assuming employment of the intermediate support member 18, the container 14 may be releasably attached thereto by means such as stud-and-slot, tongue-and-groove, snap fastener or other type of engaging means. Where container removal is not essential, it may be permanently fastened to the element which supports it.

Figure 3:
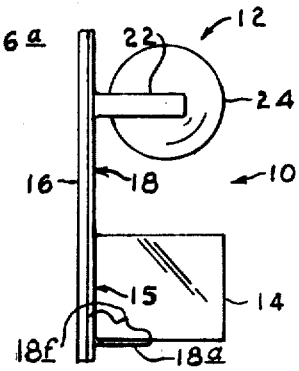
FIG. 3 is a side elevation view of another form of the fixture which includes an elongated intervening support member attached to the wall section, the toilet-tissue dispenser and the container being in vertical alignment.
Figure 4:
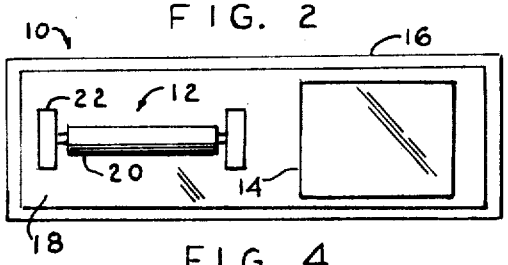
FIG. 4 is a front view of the unitary fixture including the elongated support member of FIG. 3 and in which the toilet-tissue dispenser and the container are in horizontal alignment.

FIGS. 3 and 4 illustrate use of a long flat intermediate support member 18 to which are fastened both the toilet-tissue dispenser 12 and the container 14. A vertical arrangement is shown in FIG. 3 and a horizontal disposition in FIG. 4. It is to be understood that other arrangements are also possible, e.g., the container could be positioned above the toilet-tissue dispenser or another angular relation could obtain.

Figure 8:
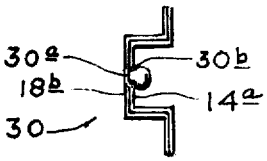
FIG. 8 shows recessed means for fastening a container to the support member.

FIG. 8 shows recessed snap fastener means 30. The male portion 30*a* is mounted on a recessed area 18*b* of support member 18. The female portion 30*b* of the snap fastener is mounted on a projecting area 14*a* of the container 14. The projecting and recessed areas are in a nested relation. Adjacent surfaces of the support member and container are thus enabled to be in contiguous relation for enhancing a firmer mounting than would otherwise be possible. Where an intermediate support member has been shown, as in FIGS. 1, 3, and 4, its attachment to the basic support means, namely, panel or section 16 may be by any means suitable to the purpose such as studs, bolts, an adhesive or the like. Fastener locations are optional, e.g., at 15 of FIG. 3.

Figure 5:
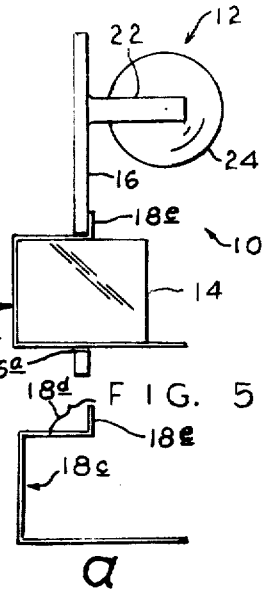
FIG. 5 is a side elevation view of another form of the fixture in which a support member and container are recessed.

FIG. 5 illustrates a structure wherein a container 14 may be recessed in a cut-away portion 16*a* of the section of panel 16. An angularly shaped support member 18*c* shown more clearly at 5*a* bears upon portions of section 16 adjacent to the cut-away area. The upper bracketed part 18*d* comprises a face plate 18*e* which is fastened to section 16 as previously described. The container 14 may be slidably inserted in or removed from the partial housing formed by member 18*c*.

Figure 6:
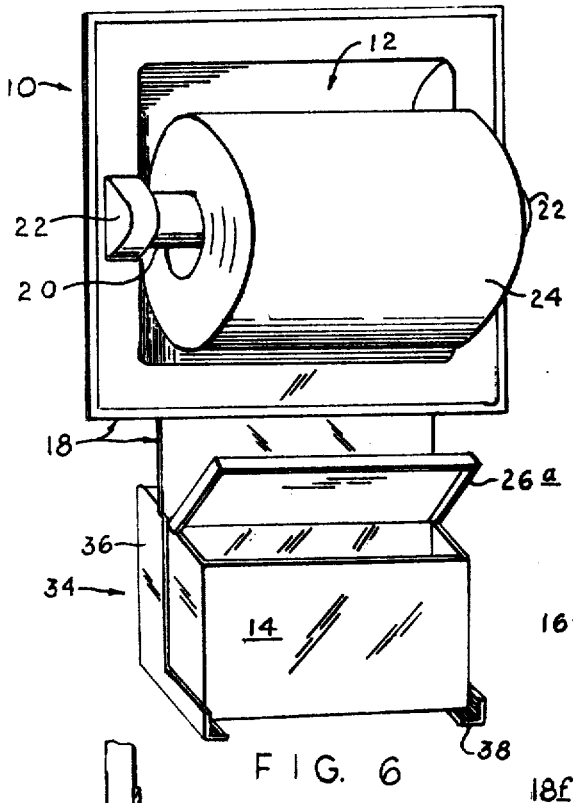
FIGS. 6 and 7 are perspective and side elevation views, respectively, of the fixture which show recessed mounting of the container.
Figure 7:
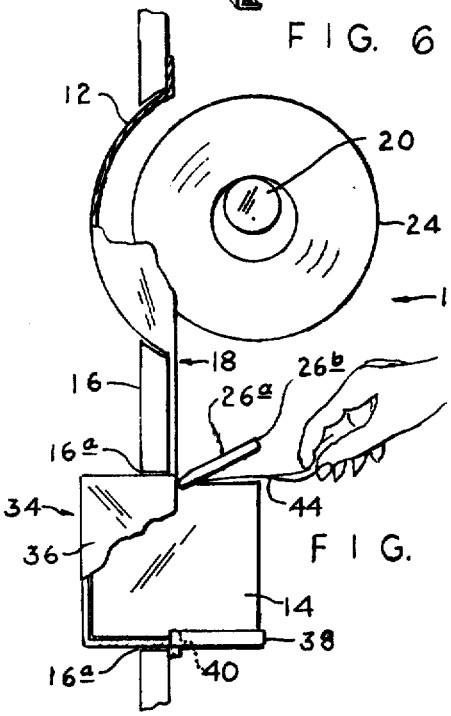

FIGS. 6 and 7 illustrate modifications of FIG. 5 in which a more complete housing 34 for acceptance of a container 14 or for service as the container, per se, is provided by the addition of side-wall portions 36, etc. Assuming the separate container 14, tracks 38 facilitate its in-and-out movement. Detent means 40 serve to hold the container at maximum inward position. A pivotal closure 26*a* may be a component of either the housing 34 or of the container 14. While the toilet-tissue dispenser 12 is also recessed in FIGS. 7 and 8, this is an optional construction.

Figure 9:
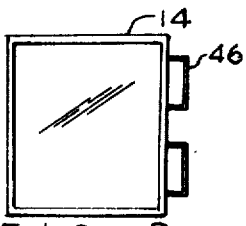
FIG. 9 is a plan view of a container with cover removed showing a pair of outwardly and upwardly projecting limit-stop elements.
Figure 10:
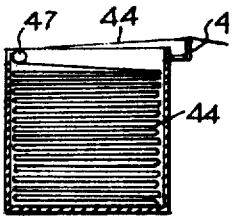
FIG. 10 is a fragmentary side view of the container and sheet material showing imminent engagement of a sheet by the limit-stop elements.
Figure 11:
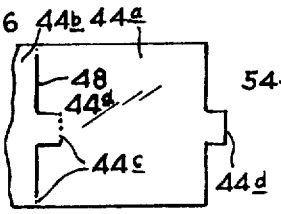
FIG. 11 is a plan view of a single sheet showing a slot and perforation pattern.

FIGS. 9–12 illustrate various means for supplying moistening materials such as disposable premoistened sheet material 44, e.g., a woven, disintegratable cloth-like material. In FIGS. 9 and 10 a pair of forwardly extending and upturned limit-stop elements 46, e.g., rigid, arch-like wire elements, are shown attached to and projecting upwardly from an end of the container 14. The overturned edge 26*b* of the container cover 26*a*, as shown in FIGS. 6 and 7, is to be considered as insertable between the elements 46 and the container body, the space therebetween being adequate for the purpose.

A continuous length of the sheet material 44 is folded on itself in the container in FIG. 10. A guide element 47 is optional. Pairs of transverse slots 48 are formed in the material at predetermined longitudinal intervals. When the material 44 is drawn manually lengthwise across the limit-stop elements 46, the latter enter the slots 48 so that further movement of the sheet material is restricted. Upon a further appliction of withdrawing force, the leading portion 44*a* of the sheet material separates from trailing portions 44*b* adjacent to the slotted area. A controlled separation is furthered by perforated or semi-perforated portions 44*c* which define a tab 44*d*. The tab, reinforced as required, remains with the trailing sheet for use in its withdrawal. The slots and perforations may be so located lengthwise of the material as to provide sheets of once, twice or even more than each folded length of the material.

Figure 12:
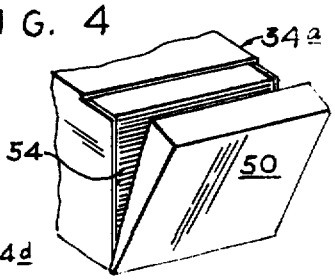
FIG. 12 is a perspective view of a container or housing component of the fixture showing stacked moistening material and illustrating a method of removal.

Further referring to FIGS. 7 and 8, the housing 34 may be of a greater length than shown so as to completely enclose an inserted container. As shown in FIG. 12, a frontal closure means 50 may then be provided. The housing 34*a* could then serve, per se, as the container if so desired. Also, the housing could be constructed separately and attached to the section 16 directly or through the instrumentality of a unitary (e.g., welded thereto) support means defined by the bracketed portion 18*f* of FIG. 3 or 18*d* of FIG. 5*a*.

Assuming the housing 34*a* to constitute the container, FIG. 12 shows a plurality of moistening units, e.g., premoistened sheets 54 stacked therein. A modification 50 of the closure means permits an improved access means to the sheets 54 which can be grasped one-by-one at their leading edges or by tabs (not shown) and withdrawn. To facilitate their removal, the under surface of each sheet could include a liquid-repellent coating or the like which would enhance its slidable movement. A plurality of interleaved sheets having a liquid-repellent coating or coatings, e.g., paraffin, would serve a similar purpose.

It is contemplated that the container 14 or housing such as 34*a* may be utilized to supply other types of units or cleansing materials such, for example as disposable douche units having frangible closure means, or such units in conjunction with the moistening materials above described. Thus, the container or housing could be compartmented to accomodate a diversity of materials.

With reference to the composition of components of the fixture, the support member, posts, spindle, container and housing may appropriately be formed of a suitable metal or metals. Alternatively, a plastic or ceramic may be employed in certain instances. The supporting section or panel 16 may suitably be composed of such non-deformable cohesive compositions as a mineral fibre tile, melamite, formica laminates, gypsum, ceramics, etc. Means for ascertaining quantities of the units present in the container or housing at any time are to be understood as included. Such means include the closures 26, 26*a* or 50 which may be opened for a rapid check. A transparent panel of the container is another means for the purpose.

Further referring to FIGS. 6 and 7, and assuming that housing 34 is enlarged to more completely enclose the container at its inward position, the cover 26*a*, if pivotally fastened to the container and biased normally in a counterclockwise direction by torsion-spring means and slightly underlying the housing, would automatically open when the container is withdrawn slightly. In this instance the container could be regarded as a slidable drawer, the tracks 38 being slightly lengthened. Alternatively the closures could include damping means to enable various open positions.

Means for supplying a toilet-tissue from a container in the form of separate, periodically perforated or interleaved sheets and for supplying pre-moistened or moistening material in a disposable medium are considered to be within the scope of the invention. The terms "housing" and "container" are to be considered as synonymous except as otherwise specified.

It will be understood that the subject invention may be practiced or embodied in other ways without departing from the character or spirit thereof. The preferred embodiment described herein is to be regarded, therefore, as illustrative and not restrictive, the scope thereof being indicated by the appended claims, and all variations which come within the meaning of the claims are intended to be embraced therein.

I claim:

1. A bathroom fixture components of which are adapted to mounting on a vertical bathroom wall section adjacent to a toilet bowl to provide both conventional dry toilet-tissue and a plurality of units of a material having at least additional cleansing properties for supplemental use therewith comprising:

a holder component for carrying and dispensing said dry toilet-tissue;

a housing component having access means thereinto for storing a supply of said supplemental cleansing units therewithin;

means for storing said units in said housing component in a given stacked arrangement for a controlled withdrawal of said units;

means forming an aperture in a given portion of said housing component for withdrawing said units in a given order;

closure means for closing and opening said aperture;

panel means constituting a section of said wall having high tensile strength adapted to serve both a conventional enclosing function of a wall and as a rigid support section for affixing said holder and housing components thereto so that they are mounted firmly against a pivotal or random displacement and in a given spatial relation;

support means for mounting said toilet-tissue holder fixedly on said panel means;

a support bracket for mounting said housing component comprising laterally spaced engageable means rigidly attached to said panel means adapted to be engaged by complementary laterally spaced engaging means of said housing component, said means permitting a given manually-actuated movement of said housing component in a predetermined plane, and limit stop means for fixing the limit of said movement of the housing component.

2. A fixture as defined in claim 1 wherein said supplemental material is a moistening material.

3. A fixture as defined in claim 1 wherein said supplemental material is in the form of premoistened sheets.

4. A fixture as defined in claim 1 wherein intermediate support means attached to said wall section is positioned between said section and said holder and container components for fastening the latter components thereto.

5. A fixture as defined in claim 1 wherein said support bracket includes recessed portions inserted in a cutaway portion of said panel means.

6. A fixture as defined in claim 1 wherein said supplemental units of cleansing material are enclosed in sheath means slidably insertable in said housing component.

7. A fixture as defined in claim 1 wherein said holder for the dry toilet-tissue is so mounted by said support means therefor as to permit at least partial recessing of the toilet tissue in a recessed area of said support means.

8. A fixture as defined in claim 1 wherein said housing is attached to mounting means therefor by nested male and female fastening means which permit contiguous surfaces of said housing and its mounting means to contact one another for maximum support.

9. A fixture as defined in claim 1 wherein is included means for determining the quantity of units in the housing at any time.

10. A fixture as defined in claim 5 wherein said laterally spaced means of said bracket comprise a pair of front-to-rear extending tracks to permit manually moving said housing component.

11. A fixture as defined in claim 3 wherein said sheets are detachable from a continuous length of said material folded on itself in a container through limit-stop means of the container which project both forwardly and upwardly beyond the limits of the container and are adapted to enter and engage transverse slots formed at lengthwise intervals of the material when the slotted portions are drawn laterally across the limit-stop means and cause severance of a leading sheet-like portion of the material while leaving a tab, defined by perforation means, for grasping and withdrawal of the next succeeding portion of the material while said material is undergoing a manually applied withdrawal force.

12. A fixture as defined in claim 3 wherein said sheets are stacked in said housing one upon the other and wherein said closure means is pivotally attached to said housing at its lower extremity and has a horizontal upper portion so that when the closure means is opened both frontal and upper portions of the sheets are exposed thus permitting their being readily grasped and removed in order, from the top sheet downward.

13. A fixture as defined in claim 12 wherein a surface of each of the sheets is provided with means impermeable to the substance providing premoistening of said sheets.

14. A fixture as defined in claim 1 wherein said support bracket comprises rearwardly extending planar members for holding said housing component at least in part rearwardly of the plane of said panel means.

15. A fixture as defined in claim 1 wherein said support bracket includes an intermediate planar panel attached to the face of said panel means.

16. A fixture as defined in claim 1 wherein said laterally spaced means comprise laterally spaced portions of contiguous planar surfaces.

17. A fixture as defined in claim 1 wherein said laterally spaced means comprise laterally spaced fastener means.

18. The housing component as defined in claim 1 for use with respectively, said toilet-tissue holder component, said support means therefor, said panel means, said support bracket, and said limit stop means of said bathroom fixture.

19. The housing component of claim 18 which is adapted to disposal when exhausted of said units.

20. A plurality of supplemental cleansing material as defined in claim 1 adapted to storing in and controlled withdrawal from said housing component.

* * * * *